US009518544B2

(12) United States Patent
Bartell et al.

(10) Patent No.: US 9,518,544 B2
(45) Date of Patent: Dec. 13, 2016

(54) FUEL RAIL WITH PRESSURE PULSATION DAMPER

(71) Applicant: DELPHI TECHNOLOGIES, INC., Troy, MI (US)

(72) Inventors: Peter E. Bartell, Ontario, NY (US); Robert Merkov, Webster, NY (US)

(73) Assignee: Delphi Technologies, Inc., Troy, MI (US)

( * ) Notice: Subject to any disclaimer, the term of this patent is extended or adjusted under 35 U.S.C. 154(b) by 640 days.

(21) Appl. No.: 13/847,068

(22) Filed: Mar. 19, 2013

(65) Prior Publication Data

US 2014/0283789 A1 Sep. 25, 2014

(51) Int. Cl.

| | |
|---|---|
| ***F02M 37/00*** | (2006.01) |
| ***F02M 55/04*** | (2006.01) |
| ***F02M 55/02*** | (2006.01) |
| ***F02M 69/46*** | (2006.01) |

(52) U.S. Cl.

CPC ..... *F02M 55/025* (2013.01); *F02M 37/0041* (2013.01); *F02M 55/04* (2013.01); *F02M 69/465* (2013.01); *F02M 37/0017* (2013.01); *F02M 2200/315* (2013.01)

(58) Field of Classification Search

CPC F02M 37/0041; F02M 37/0017; F02M 55/04; F02M 55/025; F02M 55/004; F02M 69/465; F02M 69/46; F02M 2200/315; F02M 2200/8023; F16L 55/04

USPC ..... 123/456, 457, 447, 467, 468, 469; 138/26–30, 20, 108, 112, 95

See application file for complete search history.

(56) References Cited

U.S. PATENT DOCUMENTS

| | | | | |
|---|---|---|---|---|
| 5,617,827 | A * | 4/1997 | Eshleman et al. | 123/456 |
| 5,682,857 | A * | 11/1997 | Briggs et al. | 123/456 |
| 6,205,979 | B1 | 3/2001 | Sims, Jr. et al. | |
| 6,371,083 | B1 | 4/2002 | Rossi et al. | |
| 6,418,909 | B2 | 7/2002 | Rossi et al. | |
| 6,443,131 | B1 * | 9/2002 | Bueser | 123/467 |
| 6,463,911 | B1 * | 10/2002 | Treusch et al. | 123/467 |
| 6,513,500 | B2 | 2/2003 | Braun et al. | |
| 6,513,501 | B1 * | 2/2003 | Schwegler et al. | 123/463 |
| 6,708,670 | B2 | 3/2004 | Treusch et al. | |
| 7,036,487 | B2 * | 5/2006 | Braun et al. | 123/467 |
| 7,341,045 | B2 | 3/2008 | Sims, Jr. et al. | |
| 7,497,202 | B2 * | 3/2009 | Cvengros et al. | 123/456 |
| 7,520,268 | B1 * | 4/2009 | Sims, Jr. | 123/447 |

(Continued)

FOREIGN PATENT DOCUMENTS

| | | | | |
|---|---|---|---|---|
| DE | EP 2080894 A1 * | 7/2009 | | F02M 55/025 |
| EP | 2080894 A1 * | 7/2009 | | F02M 55/02 |

*Primary Examiner* — Hung Q Nguyen
*Assistant Examiner* — George Jin
(74) *Attorney, Agent, or Firm* — Joshua M. Haines

(57) ABSTRACT

A fuel rail assembly includes a hollow fuel rail extending along a fuel rail axis and includes at least one outlet for dispensing fuel from the fuel rail. A fuel rail damper is disposed within the fuel rail and extends along a fuel rail axis from a first fuel rail damper end to a second fuel rail damper end for damping pressure pulsations within the fuel rail. A fuel rail damper support is included for positioning the fuel rail damper within the fuel rail. The fuel rail damper support includes an attachment section for fixing the fuel rail damper support to the fuel rail damper and a biasing section that applies a biasing force to prevent axial movement of the fuel rail damper within the fuel rail.

22 Claims, 5 Drawing Sheets

(56) References Cited

U.S. PATENT DOCUMENTS

| | | | | |
|---|---|---|---|---|
| 7,694,664 | B1 | 4/2010 | Sims, Jr. | |
| 7,921,881 | B2 * | 4/2011 | Zdroik et al. | 138/30 |
| 2001/0042538 | A1 * | 11/2001 | Rossi et al. | 123/456 |
| 2002/0139351 | A1 * | 10/2002 | Braun et al. | 123/463 |
| 2003/0084878 | A1 * | 5/2003 | Treusch et al. | 123/456 |
| 2003/0084879 | A1 * | 5/2003 | Treusch et al. | 123/456 |
| 2004/0140406 | A1 * | 7/2004 | Kanie | 248/73 |
| 2006/0081220 | A1 * | 4/2006 | Sims et al. | 123/467 |
| 2008/0178846 | A1 * | 7/2008 | Matsuda | F02M 69/465 123/456 |

* cited by examiner

FUEL RAIL WITH PRESSURE PULSATION DAMPER

TECHNICAL FIELD OF INVENTION

The present invention relates to a fuel rail for supplying fuel to fuel injectors of an internal combustion engine, more particularly to such a fuel rail which includes a fuel rail damper therein for damping pressure pulsations, and still event more particularly to a fuel rail damper support for positioning the fuel rail damper within the fuel rail.

BACKGROUND OF INVENTION

In modern internal combustion engines, fuel injection systems typically include a plurality of fuel injectors. A fuel rail supplies fuel to the fuel injectors. A typical fuel rail will include several sockets, within each of which is mounted a fuel injector. Thus, multiple fuel injectors typically share and are supplied with fuel by a common fuel rail. The fuel injectors are sequentially actuated to deliver fuel from the fuel rail to the inlet port of a corresponding engine cylinder according to and in sequence with the operation of the engine. The sequential operation of the fuel injectors induces variations in pressure and pressure pulsations within the common fuel rail.

U.S. Pat. No. 6,513,500; the disclosure of which is incorporated herein by reference in its entirety, discloses a fuel rail that includes a conventional fuel rail damper disposed within the fuel rail. Conventional fuel rail dampers are typically formed by a tube that is hermetically sealed and is impervious to fuel. One or more walls of the fuel rail damper flex in response to rapid pressure pulsations within the fuel rail. The flexing of the one or more walls of the fuel rail damper adsorbs energy from the pressure pulsation to thereby reduce the speed of the pressure wave and the amplitude of the pressure pulsation/spike.

Proper positioning of the fuel rail damper within the fuel rail is important for proper distribution of fuel to the fuel injectors. There are numerous features described in prior art fuel rail dampers for positioning the fuel rail damper within the fuel rail. However, these features described in the prior art for positioning the fuel rail damper within the fuel rail suffer from one or more shortfalls such as being complex to manufacture and assemble, being costly to manufacture, resulting in unsatisfactory performance, and allowing axial movement of the fuel rail damper within the fuel rail over the range of acceptable manufacturing tolerances of the fuel rail and the fuel rail damper.

What is needed is a fuel rail assembly which minimizes or eliminates one or more of the shortcomings as set forth above.

SUMMARY OF THE INVENTION

Briefly described, a fuel rail assembly is provided for supplying fuel to at least one fuel injector. The fuel rail assembly includes a hollow fuel rail extending along a fuel rail axis. The fuel rail includes a first fuel rail end disposed along the fuel rail axis, a second fuel rail end disposed along the fuel rail axis, an inlet for introducing fuel into the fuel rail, and at least one outlet for dispensing fuel from the fuel rail. A first end cap closes off the first fuel rail end and a second end cap closes off the second fuel rail end. A fuel rail damper is disposed within the fuel rail between the first end cap and the second end cap and extends along a fuel rail damper axis from a first fuel rail damper end to a second fuel rail damper end for damping pressure pulsations within the fuel rail. A fuel rail damper support is included for positioning the fuel rail damper within the fuel rail. The fuel rail damper support includes an attachment section for fixing the fuel rail damper support to the fuel rail damper and a biasing section that applies a biasing force to the first end cap to urge the fuel rail damper away from the first end cap and to prevent movement of the fuel rail damper along the fuel rail damper axis within the fuel rail.

BRIEF DESCRIPTION OF DRAWINGS

This invention will be further described with reference to the accompanying drawings in which.

DETAILED DESCRIPTION OF INVENTION

Figure 1:
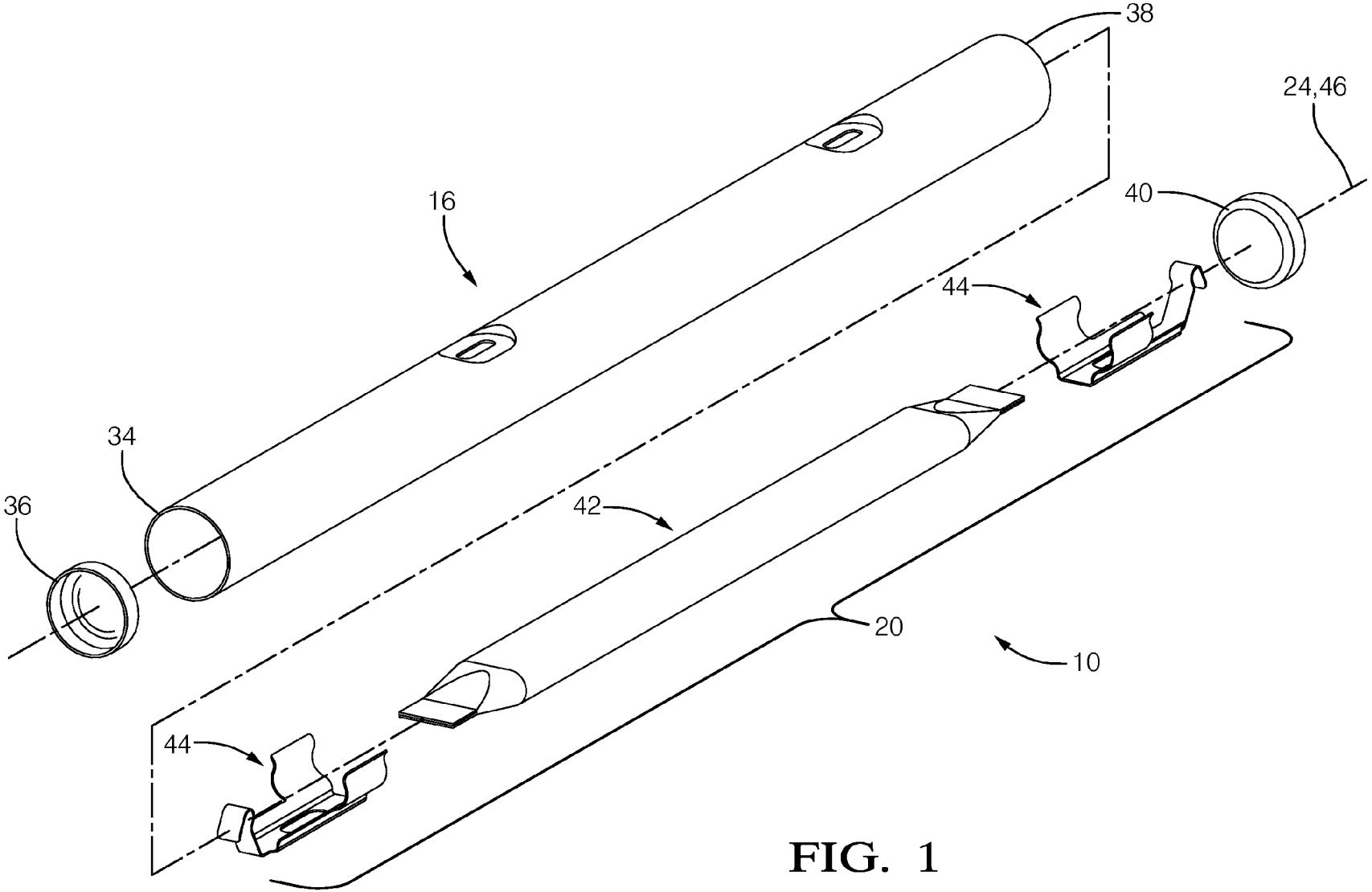
FIG. 1 is an exploded isometric view of a fuel rail assembly in accordance with the present invention.
Figure 2:
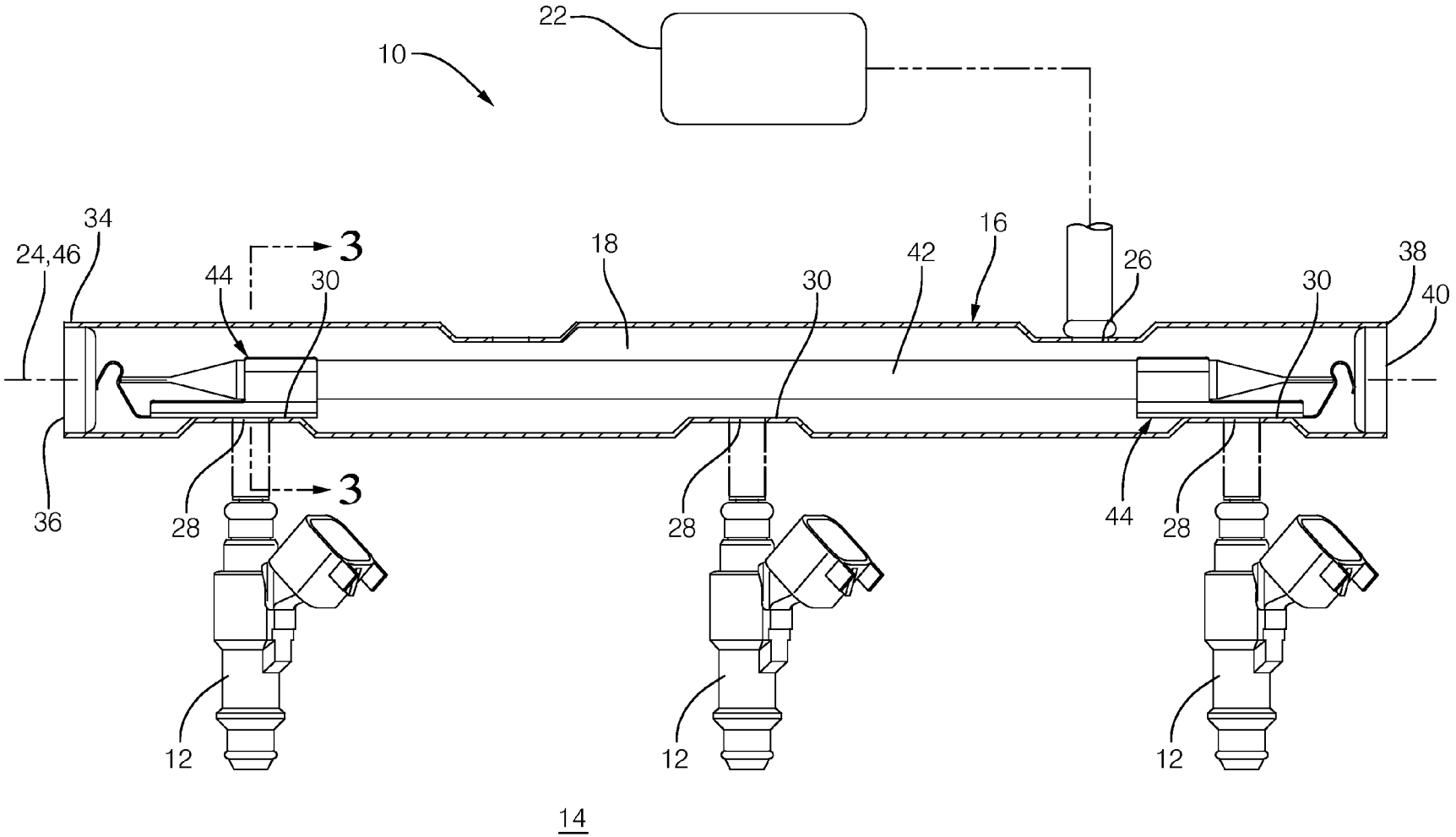
FIG. 2 is a partial axial cross-sectional view of the fuel rail assembly in accordance with the present invention.
Figure 3:
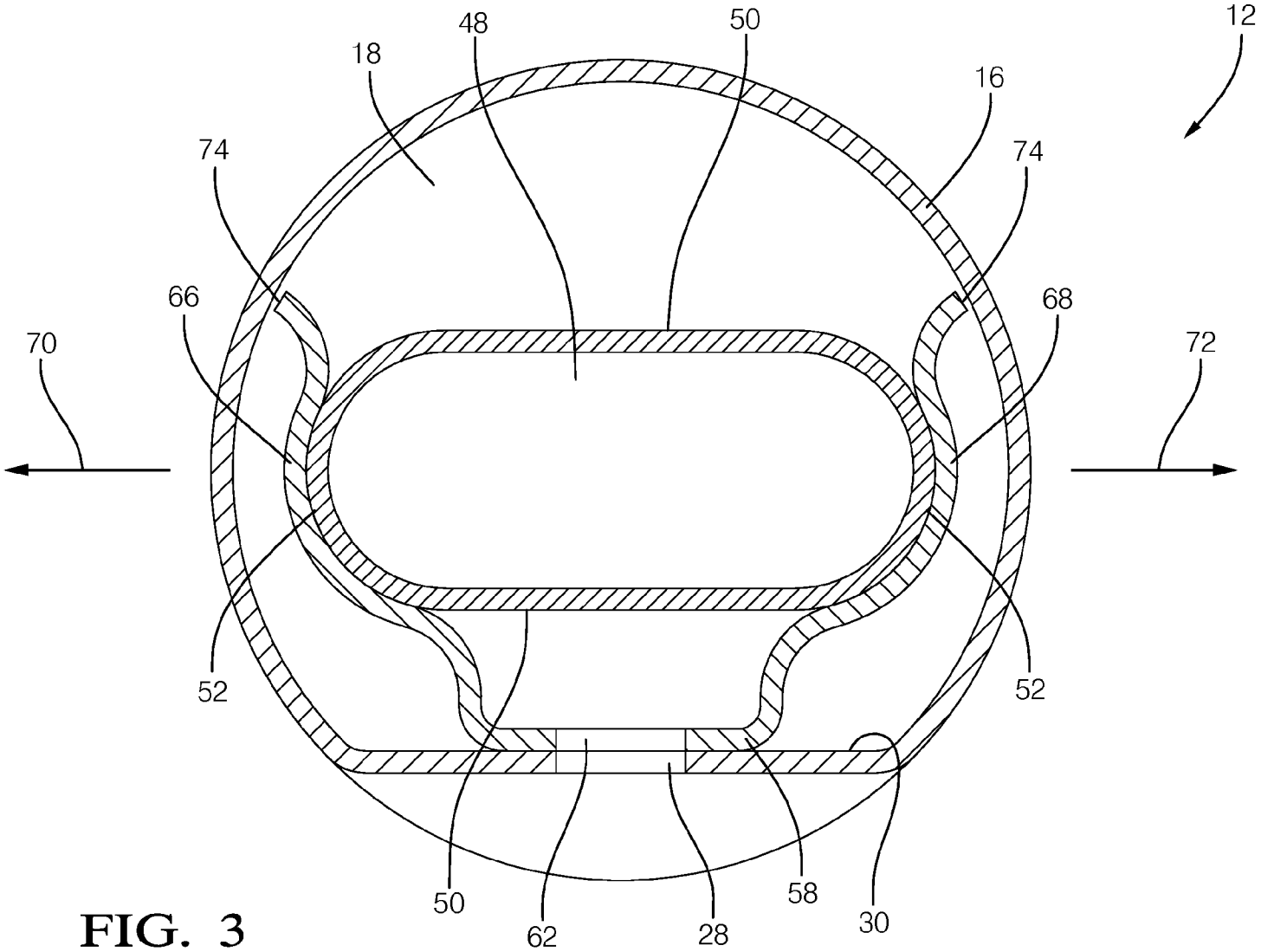
FIG. 3 is a radial cross-sectional view of the fuel rail assembly in accordance with the present invention taken along section line 3-3 of FIG. 2.

Reference will be made to FIGS. 1-3 which show fuel rail assembly 10 in accordance with the present invention for supplying fuel to a plurality of fuel injectors 12 of an internal combustion engine 14. Fuel rail assembly 10 includes fuel rail 16 for providing a fuel path from a fuel source 22, for example a fuel pump, to fuel injectors 12. Fuel rail assembly 10 also includes a fuel rail damper assembly 20 for damping pressure pulsations that may result from the operation of fuel injectors 12.

Fuel rail 16 is hollow and extends along a fuel rail axis 24 to define a fuel rail interior volume 18. While fuel rail 16 is illustrated as generally cylindrical in cross-sectional shape, it should be understood that fuel rail 16 may be any cross-sectional shape that provides adequate strength to withstand the fuel pressure generated by fuel source 22 and provides sufficient volume to supply the required quantity of fuel to fuel injectors 12 to operate internal combustion engine 14. Fuel rail 16 includes an inlet 26 for introducing fuel from fuel source 22 into fuel rail 16. Fuel rail 16 also includes a plurality of outlets 28 that each provides a path for fuel to be discharged from fuel rail 16 to a respective fuel injector 12. In order to facilitate connection of each fuel injector 12 to fuel rail 16, flats 30 may be provided in fuel rail 16 such that flats 30 protrude into fuel rail 16. While three outlets 28 and three fuel injectors 12 have been illustrated, it should now be understood that greater or lesser numbers of outlets 28 and fuel injectors 12 may be provided.

Fuel rail 16 includes a first fuel rail end 34 that is closed by a first end cap 36. First end cap 36 may, for example only, fit within the inner perimeter of fuel rail 16. The interface between first end cap 36 and fuel rail 16 may be sealed, for example only, by brazing, soldering, or welding in order to prevent leakage of fuel out of fuel rail 16 through the interface between first end cap 36 and fuel rail 16. Similarly, fuel rail 16 includes a second fuel rail end 38 that is axially opposed to first fuel rail end 34. Second fuel rail end 38 is closed by a second end cap 40 which may, for example only, fit within the inner perimeter of fuel rail 16. The interface between second end cap 40 and fuel rail 16 may be sealed, for example only, by brazing, soldering, or welding in order to prevent leakage of fuel out of fuel rail 16 through the interface between second end cap 40 and fuel rail 16.

Figure 4:
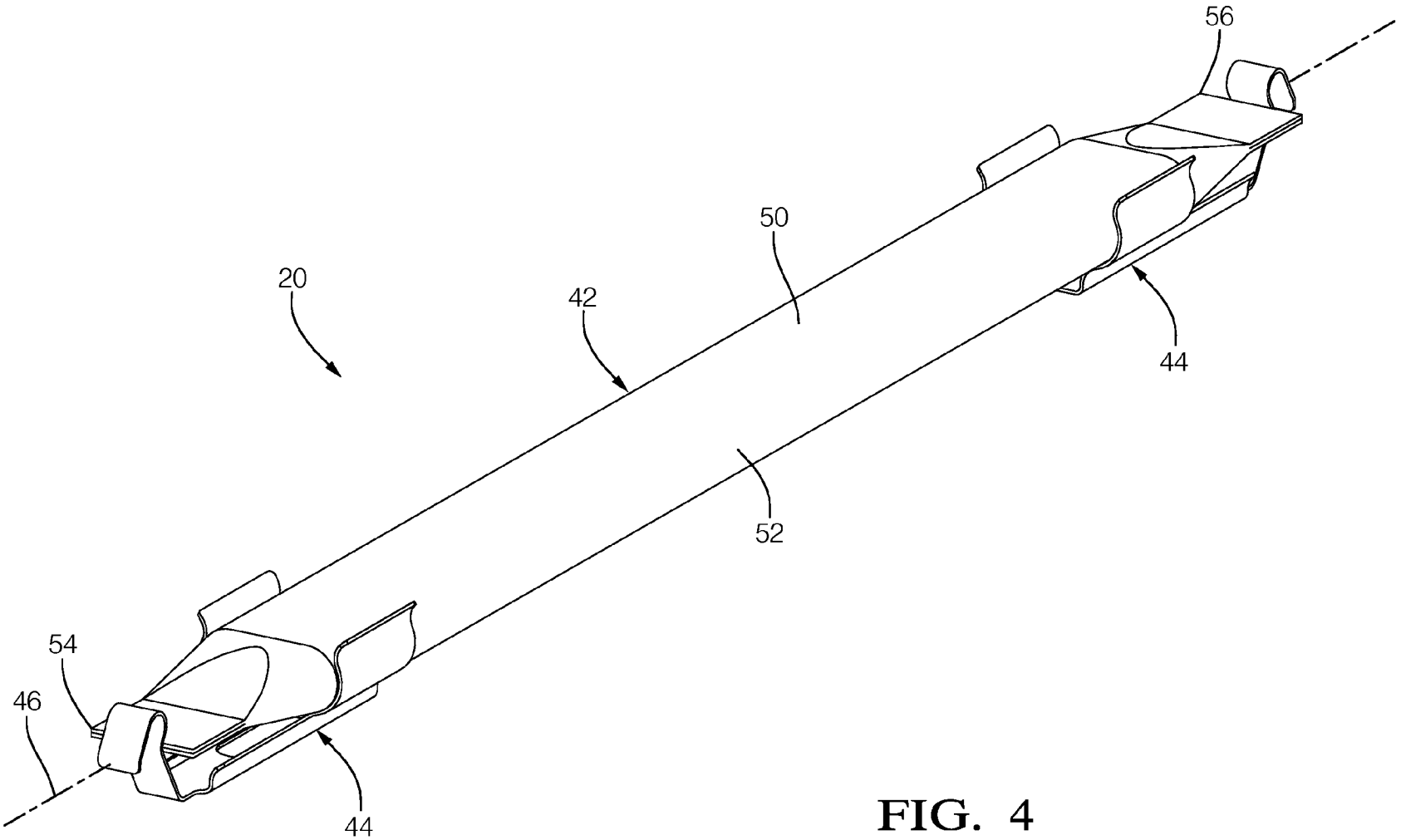
FIG. 4 is an isometric view of a fuel rail damper assembly of FIGS. 1-3.

With continued reference to FIGS. 1-3 and with additional reference to FIG. 4, fuel rail damper assembly 20 includes a fuel rail damper 42 and a pair of fuel rail damper supports 44 for positioning fuel rail damper 42 within fuel rail interior volume 18. Fuel rail damper 42 is a hollow tube extending along a fuel rail damper axis 46 that may be substantially parallel to fuel rail axis 24. While fuel rail damper axis 46 has been illustrated as coincident with fuel rail axis 24 in the figures, fuel rail damper axis 46 need not be coincident with fuel rail axis 24. Fuel rail damper 42 defines a fuel rail damper interior volume 48 that is sealed from fuel rail interior volume 18. As shown, fuel rail damper 42 includes active sides 50 that are substantially parallel to fuel rail damper axis 46 and oppose each other. Active sides 50 may be substantially planar as shown. Fuel rail damper 42 also includes connecting sides 52 that are substantially parallel to fuel rail damper axis 46. Connecting sides 52 are disposed between active sides 50 to define a contiguous perimeter radially surrounding fuel rail damper axis 46. Connecting sides 52 may be substantially arcuate in shape as shown. Fuel rail damper 42 includes a first fuel rail damper end 54 that is proximal to first fuel rail end 34 and a second fuel rail damper end 56 that is proximal to second fuel rail end 38. As shown, first fuel rail damper end 54 is sealed by crimping one end of active sides 50 and connecting sides 52 along with brazing, soldering, or welding the resulting crimp. Similarly, as shown, second fuel rail damper end 56 is sealed by crimping the other end of active sides 50 and connecting sides 52 along with brazing, soldering, or welding the resulting crimp. While not shown, it should be understood that first fuel rail damper end 54 and second fuel rail damper end 56 may be sealed with one or more of the following: plugs, caps, covers, alone or together with brazing, welding, soldering, adhesives, or sealants. In use, active sides 50 flex in response pressure pulsations that may result from the operation of fuel injectors 12, thereby damping the pressure pulsations.

Figure 5:
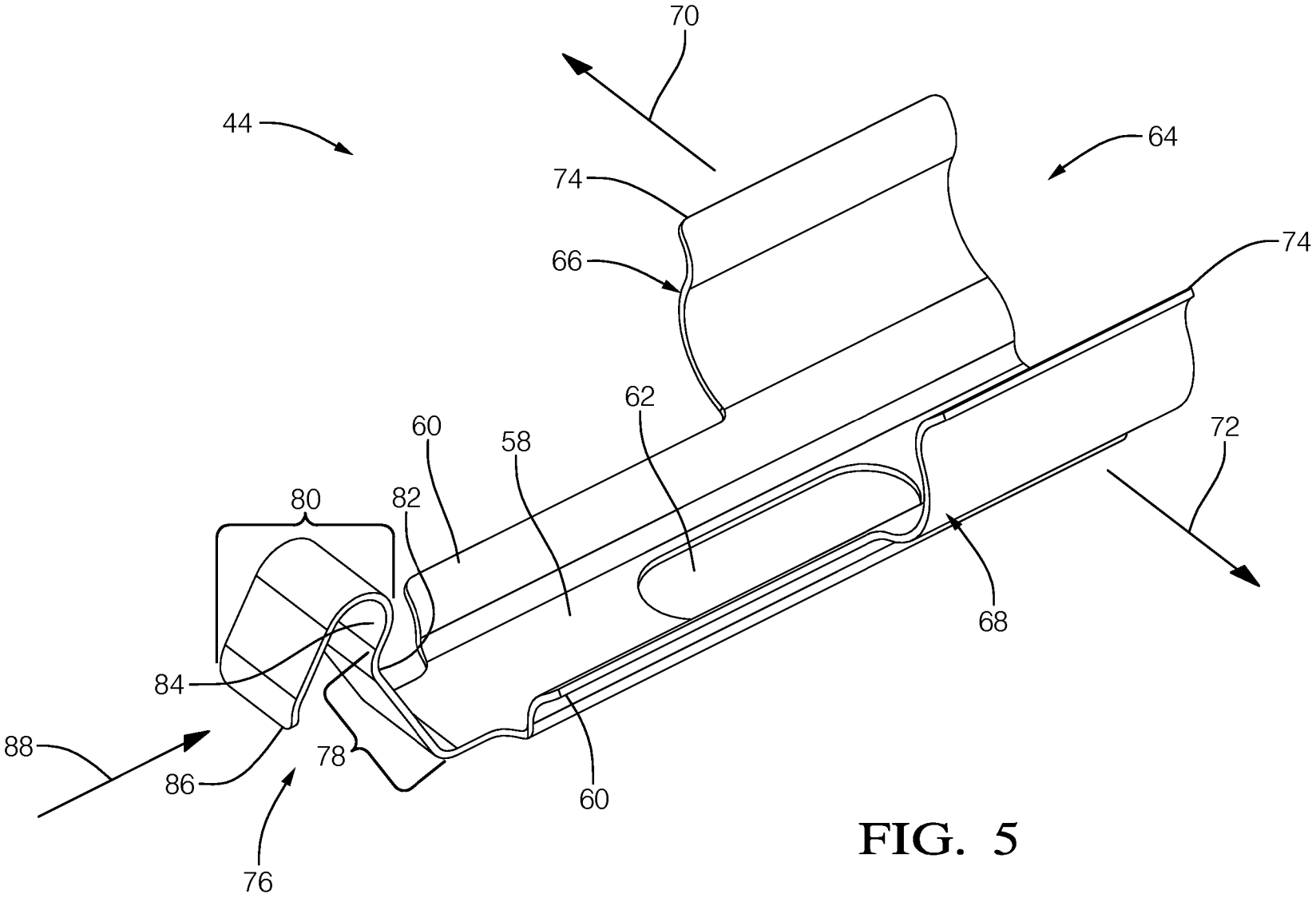
FIG. 5 is an isometric view of a fuel rail damper support of FIGS. 1-4.

Fuel rail damper supports 44 will now be described with continued reference to FIGS. 1-4 and with additional reference to FIG. 5. Fuel rail damper supports 44 may be substantially identical; consequently, the description that follows will be relative to one fuel rail damper support 44. Fuel rail damper support 44 is preferably made of a material, for example only, stainless steel, which is not negatively affected by fuels that are to be used by the internal combustion engine 14. Fuel rail damper support 44 may be made, for example, from a stamping of sheet metal that is bent to include the features that will be hereinafter described. Fuel rail damper support 44 includes a fuel rail damper support base 58 that may be substantially parallel to fuel rail damper axis 46. Fuel rail damper support base 58 may include one or more stiffening features 60, illustrated as ribs, which substantially prevent fuel rail damper support base 58 from deforming, in use, along the length of fuel rail damper support base 58 in the same direction as fuel rail damper axis 46. Fuel rail damper support base 58 sits upon one of the flats 30. In order to prevent fuel rail damper support base 58 from blocking outlet 28, fuel rail damper support base 58 may include a passage 62 that extends through fuel rail damper support base 58 in a direction that is substantially perpendicular to fuel rail damper axis 46 such that passage 62 is aligned with outlet 28. As shown, passage 62 may be an elongated slot; however, other shapes may be utilized.

Fuel rail damper support 44 also includes an attachment section 64 for fixing fuel rail damper support 44 to fuel rail damper 42. As shown, attachment section 64 may include a pair of opposing clamping arms 66, 68 such that one end of each of clamping arms 66, 68 extends from fuel rail damper support base 58 and the other end of each of clamping arms 66, 68 is free. Clamping arms 66, 68 extend from the end of fuel rail damper support base 58 that is distal from first fuel rail damper end 54 if fuel rail damper support 44 is proximal to first fuel rail damper end 54 and clamping arms 66, 68 extend from the end of fuel rail damper support base 58 that is distal from second fuel rail damper end 56 if fuel rail damper support 44 is proximal to second fuel rail damper end 56. Each opposing clamping arm 66, 68 extends from fuel rail damper support base 58 such that each clamping arm 66, 68 radially surrounds a portion of fuel rail 16. Each clamping arm 66, 68 may have a portion contoured to substantially match a portion of the outer perimeter of fuel rail 16. Prior to fuel rail damper support 44 being assembled to fuel rail damper 42, the distance between the portions of clamping arms 66, 68 that capture fuel rail damper 42 therebetween is less than the width of fuel rail damper 42. Consequently, in order to assemble fuel rail damper support 44 to fuel rail damper 42, clamping arm 66 flexes resiliently away from clamping arm 68 in the direction of arrow 70 and clamping arm 68 flexes resiliently away from clamping arm 66 in the direction of arrow 72. After fuel rail damper support 44 has been assembled to fuel rail damper 42, fuel rail damper 42 is clamped between clamping arms 66, 68 such that clamping arms 66, 68 apply a force radially inward on fuel rail damper 42. As shown, clamping arms 66, 68 radially position fuel rail damper 42 within fuel rail 16 to allow adequate fuel flow from inlet 26 to outlets 28. Each clamping arm 66, 68 has a tip section 74 that splays outward from clamping arms 66, 68 toward the inside perimeter of fuel rail 16. Tip sections 74 are located at the free end of clamping arms 66, 68 and may help to limit radial movement of fuel rail damper assembly 20 within fuel rail 16. Either tip section 74 may slide to the side along with fuel damper support 44 to engage the inner surface of fuel rail 16; however, both tip sections 74 cannot concurrently engage the inner surface of fuel rail 16. In other words, clamping arms 66, 68 hold fuel rail damper 42, but do not resiliently locate fuel rail damper 42 within fuel rail 16.

Fuel rail damper support 44 also includes a positioning arm 76 which positions fuel rail damper support 44 axially on fuel rail damper 42 along fuel rail damper axis 46 and also positions fuel rail damper assembly 20 axially within fuel rail 16 along fuel rail axis 24. One end of positioning arm 76 extends from the end of fuel rail damper support base 58 that is distal from clamping arms 66, 68 while the other end of positioning arm 76 is free. As shown, positioning arm 76 may include a positioning section 78 and a biasing section 80. Positioning section 78 is in line with fuel rail damper support base 58; however, positioning section 78 may be inclined relative to fuel rail damper support base 58. Positioning section 78 may include a concave corner 82 formed therein for receiving either first fuel rail damper end 54 or second fuel rail damper end 56. As shown, the two segments of positioning section 78 that define concave corner 82 are inclined in opposite directions relative to fuel rail damper axis 46 such that concave corner 82 faces toward fuel rail damper 42. In this way, positioning section 78 provides a positive locating feature, via concave corner 82, that abuts either first fuel rail damper end 54 or second fuel rail damper end 56 to position fuel rail damper support 44 axially on fuel rail damper 42 along fuel rail damper axis 46.

As shown, biasing section 80 may be J-shaped or hook-shaped and is flexible and resilient. Biasing section 80 includes a biasing section connecting end 84 which extends from positioning section 78. Biasing section 80 also includes a biasing section free end 86 which abuts either first end cap 36 or second end cap 40 when fuel damper rail assembly 20 has been assembled within fuel rail 16. In this way, biasing section free end 86 of each fuel rail damper support 44 is compressed toward fuel rail 16 in the direction of arrow 88 when fuel rail damper assembly 20 has been assembled within fuel rail 16. Consequently biasing section free end 86 of one fuel rail damper support 44 applies a biasing force to urge fuel rail damper 42 away from first end cap 36 and biasing section free end 86 of the other fuel rail damper support 44 applies a biasing force to urge fuel rail damper 42 away from second end cap 40, thereby positioning fuel rail damper assembly 20 axially within fuel rail 16 along fuel rail axis 24 and preventing axial movement of fuel rail damper 42 within fuel rail 16. The biasing sections 80 of the fuel rail damper supports 44 compensate for manufacturing variations which could otherwise allow axial movement of fuel rail damper 42 within fuel rail 16.

The process for assembling fuel rail assembly 10 will now be described. First end cap 36 is fixed and sealed to first fuel rail end 34 of fuel rail 16, for example, by brazing. Subsequent to first end cap 36 being fixed and sealed to fuel rail 16, fuel rail damper assembly 20 may be inserted into fuel rail 16. Next, second end cap 40 may be positioned on second fuel rail end 38 of fuel rail 16, thereby compressing biasing sections 80 of fuel rail damper supports 44 between first end cap 36 and second end cap 40. Lastly, second end cap 40 is fixed and sealed to second fuel rail end 38 of fuel rail 16, for example, by laser welding. Alternatively, fuel rail damper assembly 20 may first be inserted into fuel rail 16. Subsequent to fuel rail damper assembly 20 being inserted into fuel rail 16, first end cap 36 may be positioned at first fuel rail end 34 of fuel rail 16 and second end cap 40 may be positioned at second fuel rail end 38, thereby compressing biasing sections 80 of fuel rail damper supports 44 between first end cap 36 and second end cap 40. Lastly, first end cap 36 is fixed and sealed to first fuel rail end 34 of fuel rail 16, for example, by laser welding and second end cap 40 is fixed and sealed to second fuel rail end 38 of fuel rail 16, for example, by laser welding.

While fuel rail damper assembly 20 has been described and illustrated as having two fuel rail damper supports 44 each having biasing section 80 for positioning fuel rail damper assembly 20 axially within fuel rail 16 along fuel rail axis 24, it should now be understood that fuel rail damper assembly 20 may include only one fuel rail damper support 44 having a biasing section 80 for positioning fuel rail damper assembly 20 axially within fuel rail 16 along fuel rail axis 24. Fuel rail damper support 44 may be, for example only, positioned at the end of fuel rail damper 42 that is proximal to first end cap 36. In this way, biasing section 80 of fuel rail damper support 44 urges the end of fuel rail damper 42 into either direct or indirect contact with second end cap 40, thereby positioning fuel rail damper assembly 20 axially within fuel rail 16 along fuel rail axis 24 and preventing axial movement of fuel rail damper 42 within fuel rail 16.

While this invention has been described in terms of preferred embodiments thereof, it is not intended to be so limited.

We claim:

1. A fuel rail assembly for supplying fuel to at least one fuel injector, said fuel rail assembly comprising:

a hollow fuel rail extending along a fuel rail axis, said fuel rail having a first fuel rail end disposed along said fuel rail axis, a second fuel rail end disposed along said fuel rail axis, an inlet for introducing fuel into said fuel rail, and at least one outlet for dispensing fuel from said fuel rail;

a first end cap closing off said first fuel rail end;

a second end cap closing off said second fuel rail end;

a fuel rail damper disposed within said fuel rail between said first end cap and said second end cap and extending along a fuel rail damper axis from a first fuel rail damper end to a second fuel rail damper end for damping pressure pulsations within said fuel rail; and a fuel rail damper support for positioning said fuel rail damper within said fuel rail, wherein said fuel rail damper support comprises:

an attachment section for fixing said fuel rail damper support to said fuel rail damper;

a biasing section that applies a biasing force to said first end cap to urge said fuel rail damper axially away from said first end cap and to prevent movement of said fuel rail damper along said fuel rail damper axis within the fuel rail;

a fuel rail damper support base wherein said attachment section extends from said fuel rail damper support base; and a positioning arm extending from said fuel rail damper support base, said positioning arm including a locating surface which abuts said first fuel rail damper end such that said first fuel rail damper end is an endmost distal section of said fuel rail damper.

2. A fuel rail assembly as in claim 1 wherein said biasing section is held in compression.

3. A fuel rail assembly as in claim 1 wherein said attachment section includes a pair of opposing clamping arms such that each of said clamping arms radially surrounds a portion of said fuel rail damper.

4. A fuel rail assembly as in claim 3 wherein said clamping arms apply a force radially inward on said fuel rail damper.

5. A fuel rail assembly as in claim 3 wherein each of said clamping arms includes a portion contoured to substantially match a portion of the outer perimeter of said fuel rail.

6. A fuel rail assembly as in claim 1 wherein said positioning arm is inclined to said fuel rail damper axis.

7. A fuel rail assembly as in claim 1 wherein said positioning arm includes two segments that define said locating surface.

8. A fuel rail assembly as in claim 7 wherein said two segments are inclined in opposite directions relative to said fuel rail damper axis.

9. A fuel rail assembly as in claim 1 wherein said biasing section extends from said positioning arm.

10. A fuel rail assembly as in claim 9 wherein said biasing section is J-shaped.

11. A fuel rail assembly comprising:

a hollow fuel rail extending along a fuel rail axis, said fuel rail having a first fuel rail end disposed along said fuel rail axis, a second fuel rail end disposed along said fuel rail axis, an inlet for introducing fuel into said fuel rail, and a plurality of outlets for dispensing fuel from said fuel rail;

a first end cap closing off said first fuel rail end;

a second end cap closing off said second fuel rail end;

a fuel rail damper disposed within said fuel rail between said first end cap and said second end cap and extending along a fuel rail damper axis from a first fuel rail damper end to a second fuel rail damper end for damping pressure pulsations within said fuel rail; and a first fuel rail damper support and a second fuel rail damper support for positioning said fuel rail damper within said fuel rail, wherein said first fuel rail damper support and said second fuel rail damper support each comprise:

an attachment section for fixing said fuel rail damper support to said fuel rail damper;

a biasing section;

a fuel rail damper support base wherein said attachment section extends from said fuel rail damper support base; and a positioning arm extending from said fuel rail damper support base, said positioning arm including a locating surface, wherein said locating surface of said first fuel rail damper support abuts said first fuel rail damper end and said locating surface of said second fuel rail damper support abuts said second fuel rail damper end such that said first fuel rail damper end is a first endmost distal section of said fuel rail damper and such that said second fuel rail damper end is a second endmost distal section of said fuel rail damper;

wherein said biasing section of said first fuel rail damper support applies a biasing force to urge said fuel rail damper axially away from said first end cap and wherein said biasing section of said second fuel rail damper support applies a biasing force to urge said fuel rail damper axially away from said second end cap, thereby preventing movement of said fuel rail damper along said fuel rail damper axis within said fuel rail.

12. A fuel rail assembly as in claim 11 wherein said biasing section of said first fuel rail damper support is held in compression and wherein said biasing section of said second fuel rail damper support is held in compression.

13. A fuel rail assembly as in claim 11 wherein said attachment section includes a pair of opposing clamping arms such that each of said clamping arms radially surrounds a portion of said fuel rail damper.

14. A fuel rail assembly as in claim 13 wherein said clamping arms apply a force radially inward on said fuel rail damper.

15. A fuel rail assembly as in claim 13 wherein each of said clamping arms includes a portion contoured to substantially match a portion of the outer perimeter of said fuel rail.

16. A fuel rail assembly as in claim 11 wherein said positioning arm is inclined to said fuel rail damper axis.

17. A fuel rail assembly as in claim 11 wherein said positioning arm includes two segments that define said locating surface.

18. A fuel rail assembly as in claim 17 wherein said two segments are inclined in opposite directions relative to said fuel rail damper axis.

19. A fuel rail assembly as in claim 11 wherein said biasing section extends from said positioning arm.

20. A fuel rail assembly as in claim 19 wherein said biasing section is J-shaped.

21. A fuel rail assembly for supplying fuel to at least one fuel injector, said fuel rail assembly comprising:

a hollow fuel rail extending along a fuel rail axis, said fuel rail having a first fuel rail end disposed along said fuel rail axis, a second fuel rail end disposed along said fuel rail axis, an inlet for introducing fuel into said fuel rail, and at least one outlet for dispensing fuel from said fuel rail;

a first end cap closing off said first fuel rail end;

a second end cap closing off said second fuel rail end;

a fuel rail damper disposed within said fuel rail between said first end cap and said second end cap and extending along a fuel rail damper axis from a first fuel rail damper end to a second fuel rail damper end for damping pressure pulsations within said fuel rail; and a fuel rail damper support for positioning said fuel rail damper within said fuel rail, wherein said fuel rail damper support comprises:

an attachment section for fixing said fuel rail damper support to said fuel rail damper;

a biasing section that applies a biasing force to said first end cap to urge said fuel rail damper axially away from said first end cap and to prevent movement of said fuel rail damper along said fuel rail damper axis within the fuel rail; and a fuel rail damper support base, wherein said attachment section extends from said fuel rail damper support base and wherein said fuel rail damper support base includes a passage extending therethrough such that said passage is aligned with said outlet to allow fuel through said passage to said outlet.

22. A fuel rail assembly comprising:

a hollow fuel rail extending along a fuel rail axis, said fuel rail having a first fuel rail end disposed along said fuel rail axis, a second fuel rail end disposed along said fuel rail axis, an inlet for introducing fuel into said fuel rail, and a plurality of outlets for dispensing fuel from said fuel rail;

a first end cap closing off said first fuel rail end;

a second end cap closing off said second fuel rail end;

a fuel rail damper disposed within said fuel rail between said first end cap and said second end cap and extending along a fuel rail damper axis from a first fuel rail damper end to a second fuel rail damper end for damping pressure pulsations within said fuel rail; and a first fuel rail damper support and a second fuel rail damper support for positioning said fuel rail damper within said fuel rail, wherein said first fuel rail damper support and said second fuel rail damper support each comprise:

an attachment section for fixing said fuel rail damper support to said fuel rail damper;

a biasing section; and a fuel rail damper support base, wherein said attachment section extends from said fuel rail damper support base and wherein said fuel rail damper support base includes a passage extending therethrough such that said passage is aligned with one of said plurality of outlets to allow fuel through said passage to said one of said plurality of outlets;

wherein said biasing section of said first fuel rail damper support applies a biasing force to urge said fuel rail damper axially away from said first end cap and wherein said biasing section of said second fuel rail damper support applies a biasing force to urge said fuel rail damper axially away from said second end cap, thereby preventing movement of said fuel rail damper along said fuel rail damper axis within said fuel rail.

* * * * *